US008573168B2

(12) United States Patent
Yang et al.

(10) Patent No.: US 8,573,168 B2
(45) Date of Patent: Nov. 5, 2013

(54) HYDRAULIC PRESSURE VALVE APPARATUS

(75) Inventors: Jei Choon Yang, Yongin-si (KR); Chang Ho Yang, Osan-si (KR); Byong Young Choi, Bucheon-si (KR); Young Hong Kwak, Suwan (KR); Jin Kook Kong, Suwan-si (KR); Soo Hyung Woo, Yongin-si (KR)

(73) Assignee: Hyundai Motor Company, Seoul (KR)

( * ) Notice: Subject to any disclaimer, the term of this patent is extended or adjusted under 35 U.S.C. 154(b) by 41 days.

(21) Appl. No.: 13/315,151

(22) Filed: Dec. 8, 2011

(65) Prior Publication Data

US 2012/0280162 A1 Nov. 8, 2012

(30) Foreign Application Priority Data

May 4, 2011 (KR) ..... 10-2011-0042617

(51) Int. Cl.
*F01L 1/34* (2006.01)

(52) U.S. Cl.
USPC ..... 123/90.16; 123/90.48

(58) Field of Classification Search
USPC ..... 123/90.16, 90.48, 90.12
See application file for complete search history.

(56) References Cited

U.S. PATENT DOCUMENTS 7,040,266 B1 * 5/2006 Sun et al. ..... 123/90.16
7,194,990 B2 3/2007 Sun

FOREIGN PATENT DOCUMENTS

JP 2010-116797 (A) 5/2010

* cited by examiner

*Primary Examiner* — Zelalem Eshete
(74) *Attorney, Agent, or Firm* — Morgan, Lewis & Bockius LLP

(57) ABSTRACT

A hydraulic pressure valve apparatus includes a housing of which a first chamber and a second chamber are formed therein, wherein a diameter of the second chamber is bigger than that of the first chamber, a first piston disposed within the first chamber, an elastic portion disposed within the first chamber for elastically supporting the first piston and a second piston disposed within the second chamber and connected to a valve.

17 Claims, 7 Drawing Sheets

HYDRAULIC PRESSURE VALVE APPARATUS

CROSS-REFERENCE TO RELATED APPLICATION

This application claims priority to and the benefit of Korean Patent Application No. 10-2011-0042617 filed May 4, 2011, the entire contents of which application is incorporated herein for all purposes by this reference.

BACKGROUND OF INVENTION

1. Field of Invention

The present invention relates to a variable valve apparatus. More particularly, the present invention relates to a hydraulic pressure valve apparatus.

2. Description of Related Art

An internal combustion engine generates power by burning fuel in a combustion chamber in air media drawn into the chamber. Intake valves are operated by a camshaft in order to intake the air, and the air is drawn into the combustion chamber while the intake valves are open. In addition, exhaust valves are operated by the camshaft, and a combustion gas is exhausted from the combustion chamber while the exhaust valves are open.

An optimal operation of the intake valves and the exhaust valves depends on a rotation speed of the engine. That is, an optimal lift or optimal opening/closing timing of the valves depends on the rotation speed of the engine. In order to achieve such an optimal valve operation depending on the rotation speed of the engine, various research has been undertaken. For example, a valve for driving a valve is designed having different shapes, a variable valve lift apparatus has variable different lifts depending on an engine speed and so on.

However, since a CVVL (continuous variable valve lift apparatus) which is controlled mechanically, uses a link, eccentric cam a control shaft and so on, so that moment of inertia and accumulated clearance is relatively large, and development of dynamic characteristic of a valve is limited.

Also, each valve is controlled by the same camshaft simultaneously, realizing valve lift is limited.

For overcoming the drawbacks, an electric-hydraulic pressure variable lift apparatus has been developed.

FIG. 7 is a graph showing a valve profile and oil pressure of a conventional electric-hydraulic pressure variable valve apparatus.

Referring to FIG. 7, when a valve is opened, a piston may not descend smoothly due to resistance. That is, as shown in the graph, hydraulic pressure peak is generated as well as noise is generated.

The information disclosed in this Background section is only for enhancement of understanding of the general background of the invention and should not be taken as an acknowledgement or any form of suggestion that this information forms the prior art already known to a person skilled in the art.

SUMMARY OF INVENTION

Various aspects of the present invention provide for a hydraulic pressure valve apparatus having advantages of controlling valve lift according to engine operation conditions.

Various aspects of the present invention provide for a hydraulic pressure valve apparatus which may minimize hydraulic pressure peak so as to suppress impact noise.

A hydraulic pressure valve apparatus according to various aspects of the present invention may include a housing of which a first chamber and a second chamber are formed therein, wherein a diameter of the second chamber is bigger than that of the first chamber, a first piston disposed within the first chamber, an elastic portion disposed within the first chamber for elastically supporting the first piston and a second piston disposed within the second chamber and connected to a valve.

The hydraulic pressure valve apparatus may further include a movement limiting portion which limits movement of the first piston.

The movement limiting portion may include a movement limiting hole formed to the first piston and a movement limiting pin connected to the housing and inserted into the movement limiting hole.

The first piston may have a cross section shaped as "T" and the first piston may include a body portion and a head portion.

An upper portion of the first chamber where the movement limiting pin is connected may have a first interior diameter and a lower portion of the first chamber where the movement limiting pin is connected may have a second interior diameter, wherein the second diameter may be smaller than the first diameter.

An interior diameter of the second chamber may be a third diameter and the third diameter may be bigger than the first diameter.

The head portion and the second chamber may form an oil storing portion when the valve is opened.

An exterior diameter of the head portion may be smaller than the third diameter.

A chamfer may be formed where the body portion and the head portion may be connected toward the second chamber direction.

The chamfer may be formed as a curved surface.

A maximum diameter of the chamfer may be bigger than the second diameter.

A tiny passage may be formed to the first piston for controlling the valve closing speed.

The first chamber may include a first body having an interior diameter as a first diameter and a second body having an interior diameter as a second diameter and formed under the first body, wherein the second diameter may be smaller than the first diameter.

An interior diameter of the second chamber may be a third diameter and the third diameter is bigger than the first diameter.

The first piston may have a cross section shaped as "T" and the first piston may include a body portion and a head portion.

An exterior diameter of the head portion may be smaller than the third diameter.

A chamfer may be formed as a curved surface where the body portion and the head portion may be connected toward the second chamber direction.

A maximum diameter of the chamfer may be bigger than the second diameter.

A tiny passage may be formed to the first piston for controlling the valve closing speed.

A hydraulic pressure valve apparatus according to various aspects of the present invention may minimize hydraulic pressure peak so as to suppress impact noise.

The methods and apparatuses of the present invention have other features and advantages which will be apparent from or are set forth in more detail in the accompanying drawings, which are incorporated herein, and the following Detailed Description, which together serve to explain certain principles of the present invention.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention (s) is/are intended to cover not only the exemplary embodiments, but also various alternatives, modifications, equivalents and other embodiments, which may be included within the spirit and scope of the invention as defined by the appended claims.

Figure 1:
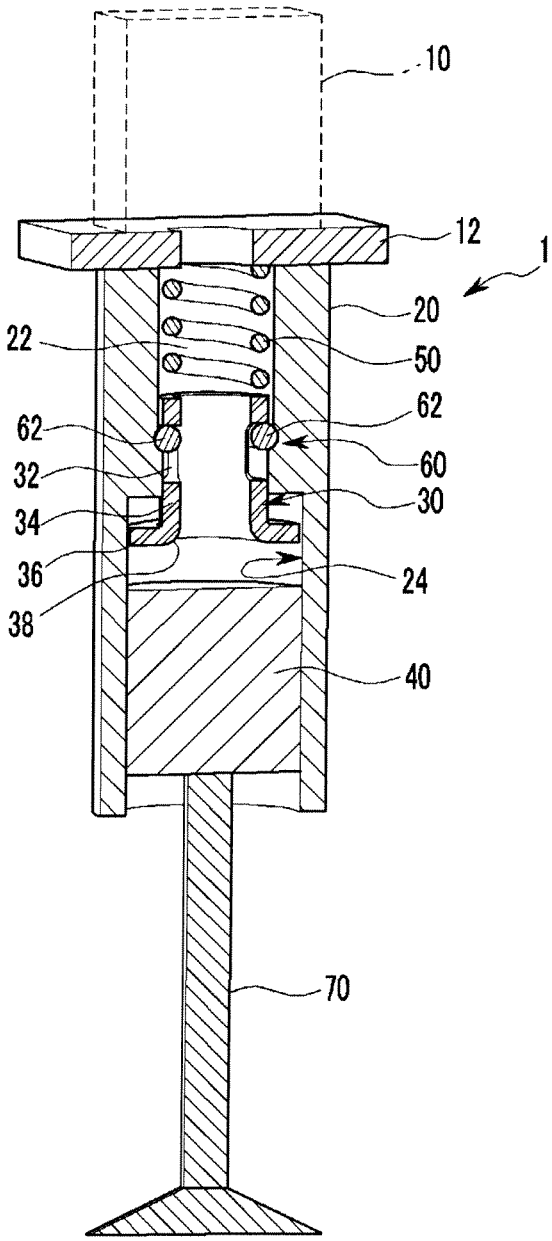
FIG. 1 is a cross-sectional view of an exemplary hydraulic pressure valve apparatus according to the present invention.
Figure 2:
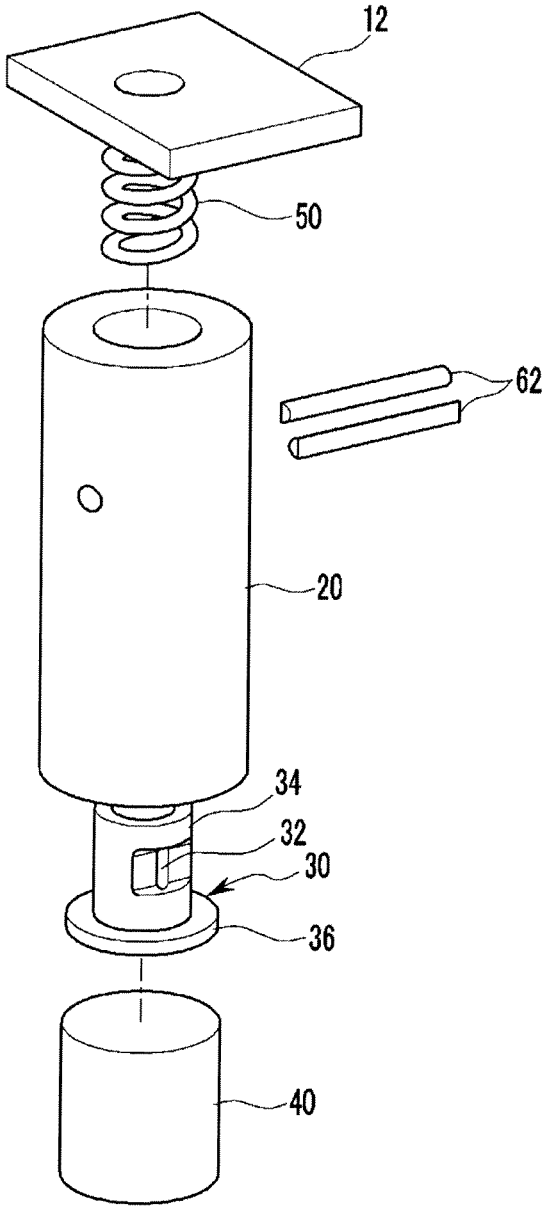
FIG. 2 is a developed view of an exemplary hydraulic pressure valve apparatus according to the present invention.

FIG. 1 is a cross-sectional view of a hydraulic pressure valve apparatus according to various embodiments of the present invention, and FIG. 2 is a developed view of a hydraulic pressure valve apparatus according to various embodiments of the present invention.

FIG. 3 to FIG. 6 are partial cross-sectional views of a hydraulic pressure valve apparatus according to various embodiments of the present invention showing operations of the hydraulic pressure valve apparatus.

Figure 6:
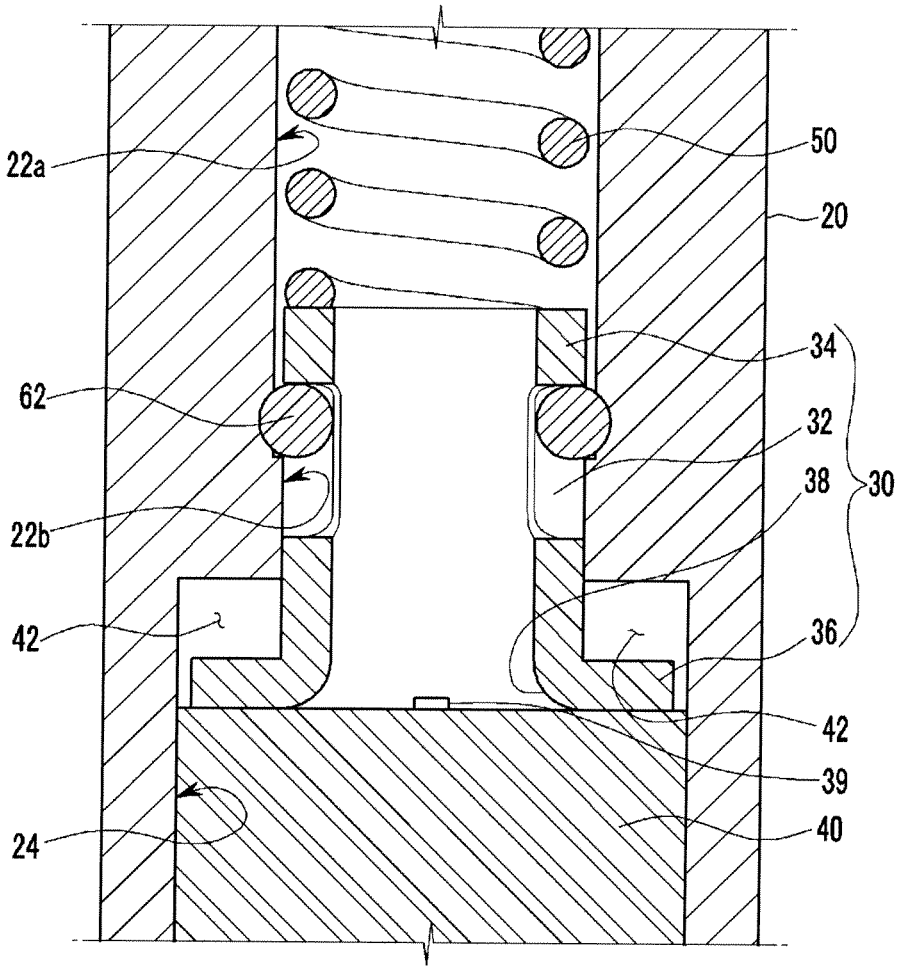
Figure 7:
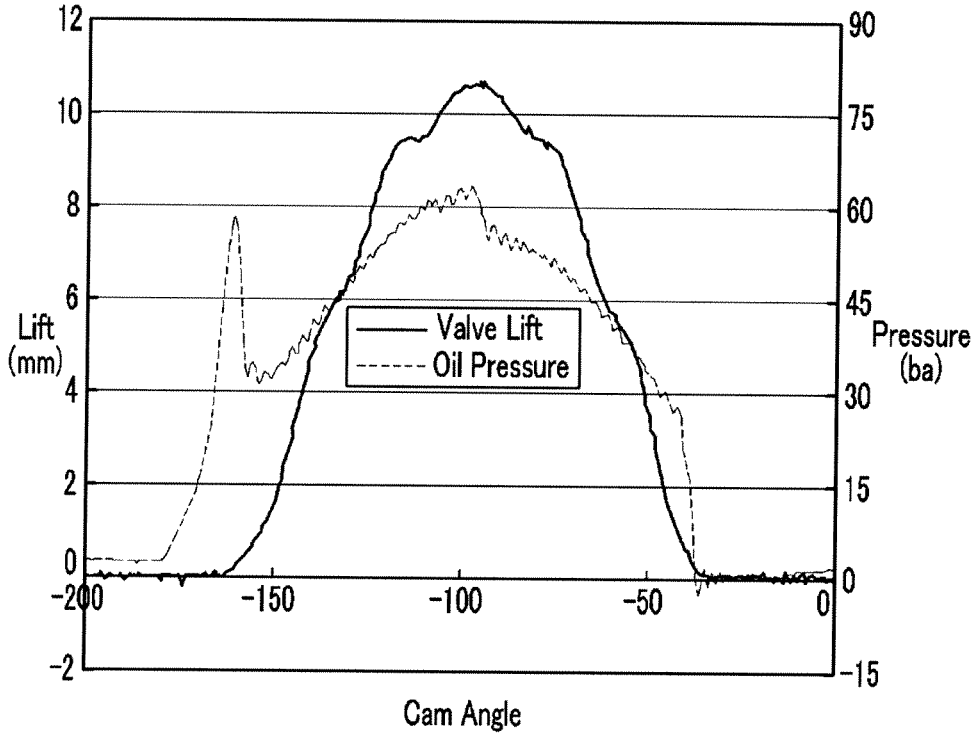
FIG. 7 is a graph showing a valve profile and oil pressure of a conventional electric-hydraulic pressure variable valve apparatus.

FIG. 1 to referring to FIG. 6, a hydraulic pressure valve apparatus 1 according to various embodiments of the present invention includes a housing 20 of which a first chamber 22 and a second chamber 24 are formed therein, wherein a diameter of the second chamber 24 is bigger than that of the first chamber 22, a first piston 30 disposed within the first chamber 22, an elastic portion 50 disposed within the first chamber 22 for elastically supporting the first piston 30 and a second piston 40 disposed within the second chamber 24 and connected to a valve 70.

A hydraulic pressure supply portion 10 for supplying hydraulic pressure to the first chamber 22 is disposed and the housing 20 is connected to an engine body 12. In this case, the engine body 12 means an engine, a cylinder head and so on.

The hydraulic pressure valve apparatus 1 further includes a movement limiting portion 60 which limits movement of the first piston 30.

The movement limiting portion 60 includes a movement limiting hole 32 formed to the first piston 30 and a movement limiting pin 62 connected to the housing 20 and inserted into the movement limiting hole 32.

Figure 3:
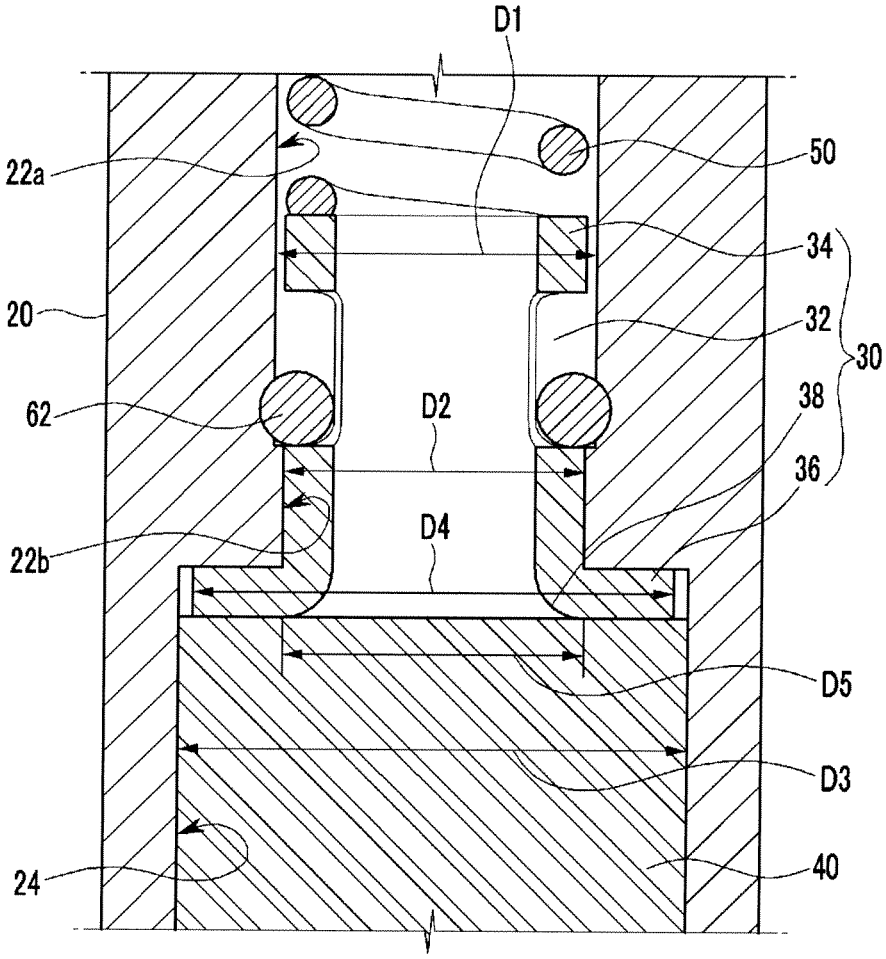
FIG. 3 to FIG. 6 are partial cross-sectional views of an exemplary hydraulic pressure valve apparatus according to the present invention showing operations of the hydraulic pressure valve apparatus.

Referring to FIG. 3, in the first chamber 22, an upper portion of the first chamber 22 where the movement limiting pin 62 is connected has a first interior diameter D1 and a lower portion of the first chamber 22 where the movement limiting pin 62 is connected has a second interior diameter D2, wherein the second diameter D2 is smaller than the first diameter D1.

That is, the first chamber 22 includes a first body 22*a* having an interior diameter as a first diameter D1 and a second body 22*b* having an interior diameter as a second diameter D2 and formed under the first body 22*a*, wherein the second diameter D2 is smaller than the first diameter D1.

An interior diameter of the second chamber 24 is a third diameter D3 and the third diameter D3 is bigger than the first diameter D1.

The first piston 30 has a cross section shaped as "T" and the first piston 30 includes a body portion 34 and a head portion 36.

Figure 4:
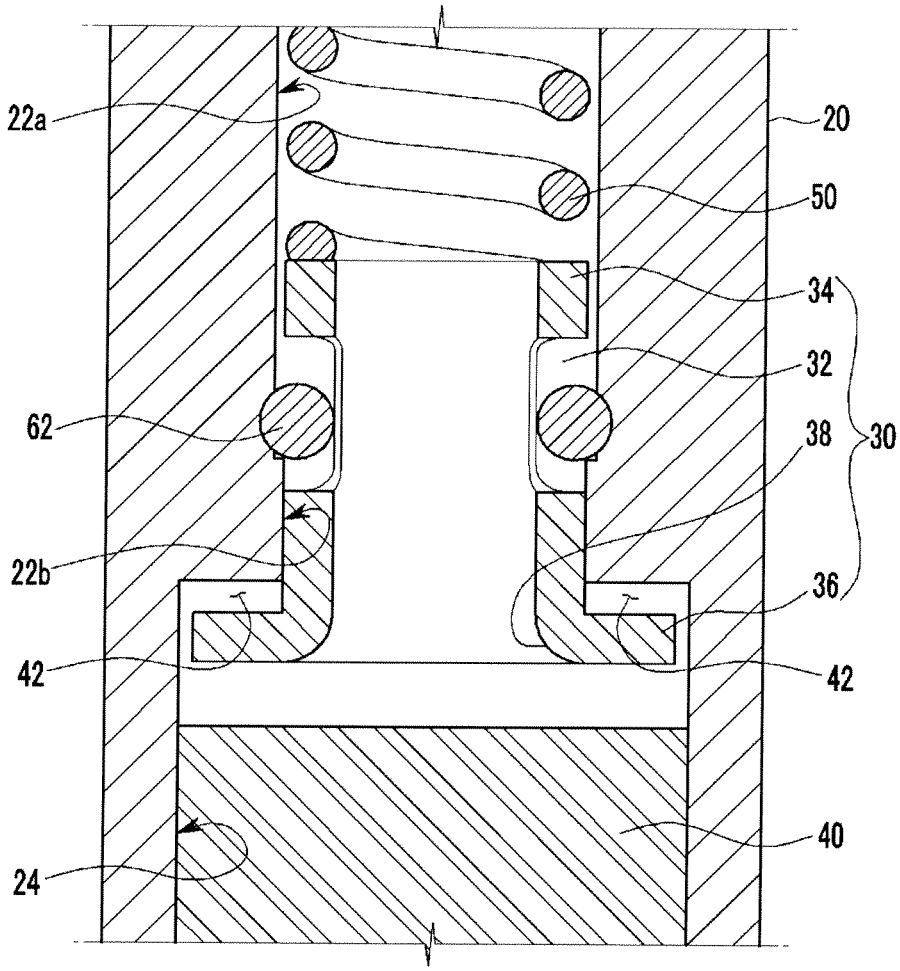

Referring to FIG. 4, the head portion 36 forms an oil storing portion 42 with the second chamber 24 when the valve 70 is opened.

An exterior diameter D4 of the head portion 36 is smaller than the third diameter D3.

A chamfer 38 is formed where the body portion 34 and the head portion 36 are connected toward the second chamber 24 direction.

The chamfer 38 is formed as a curved surface and a maximum diameter D5 of the chamfer 38 is bigger than the second diameter D2.

Referring to FIG. 6, a tiny passage 30 is formed to the first piston 30 for controlling the valve 70 closing speed, and if a size of the tiny passage 30 is adjusted, the valve 70 closing speed may be controlled.

Hereinafter, referring to FIG. 3 to FIG. 6, operations of hydraulic pressure valve apparatus according to various embodiments of the present invention will be described.

In the early stage of the valve opening, as shown in FIG. 3, when high pressure oil pushes the second piston 40 to be descended, force pushing the body portion 34 to the lower direction and force pushing the chamfer 38 to the upper direction are partially interfered because the maximum diameter D5 of the chamfer 38 is bigger than the second diameter D2, and the first piston 30 descends by elastic force of the elastic portion 50 relatively slower than the second piston 40.

And thus, the first piston 30 and the second piston 40 are smoothly separated each other without resistance or impact, so that possibilities generating peak hydraulic pressure within the housing 20 may be reduced.

In the middle stage of the valve opening, as shown in FIG. 4, the oil may flow into the movement limiting hole 32 and the oil storing portion 42 formed between the head portion 36 and the second chamber 24 and thus ramp is formed.

And thus, in the early and middle stage of the valve opening, possibilities generating peak hydraulic pressure within the housing 20 may be reduced so that the valve 70 may be opened smoothly.

Figure 5:
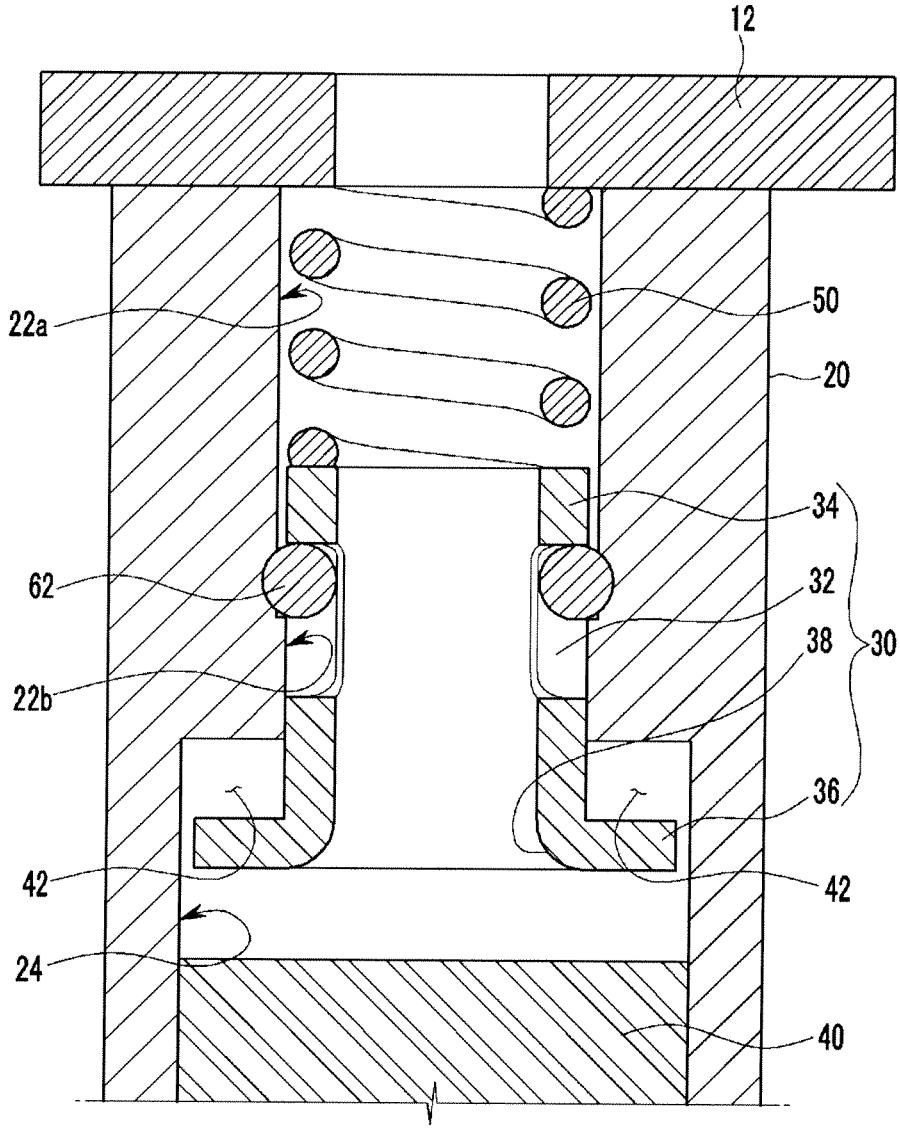

And also, as shown in FIG. 5, since relative descending speed of the first piston 30 is slow, impact between the first piston 30 and the movement limiting pin 62 may be reduced, and thus impact noise may be reduced.

After the moment of contacting the first piston 30 with the movement limiting pin 62, all of the oil is supplied to pushes the second piston 40 and thus descending speed of the second piston 40 is increased so that supplying fresh air or air/fuel mixture or exhausting exhaust gas may be quickly and smoothly possible.

In the valve 70 closing, as shown in FIG. 6, since the exterior diameter D4 of the head portion 36 is smaller than the third diameter D3, the second piston 40 moves up in advance and contacts the first piston 30, and the oil storing portion 42 absorbs shock so that impact and impact noise may be reduced.

After contacting the second piston 40 with the first piston 30, the oil within the oil storing portion 42 may be exhausted slowly through tiny gap between the second piston 40 and the first piston 30/or the housing 20, and thus the valve 70 may be smoothly closed.

If the tiny passage 39 is formed and a size of the tiny passage 39 is adjusted, closing speed of the valve 70 may be controlled.

For convenience in explanation and accurate definition in the appended claims, the terms upper or lower, and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A hydraulic pressure valve apparatus comprising:

a housing including a first chamber and a second chamber formed therein, wherein a diameter of the second chamber is bigger than that of the first chamber;

a first piston disposed within the first chamber;

an elastic portion disposed within the first chamber for elastically supporting the first piston; and a second piston disposed within the second chamber and connected to a valve;

wherein the hydraulic pressure valve apparatus further comprises a movement limiting portion limiting movement of the first piston; and wherein the movement limiting portion comprises:

a movement limiting hole formed in the first piston; and a movement limiting pin connected to the housing and inserted into the movement limiting hole.

2. The hydraulic pressure valve apparatus of claim 1, wherein the first piston has a cross section shaped as "T" and the first piston comprises a body portion and a head portion.

3. The hydraulic pressure valve apparatus of claim 2, wherein:

an upper portion of the first chamber where the movement limiting pin is connected has a first interior diameter; and a lower portion of the first chamber where the movement limiting pin is connected has a second interior diameter;

wherein the second diameter is smaller than the first diameter.

4. The hydraulic pressure valve apparatus of claim 3, wherein an interior diameter of the second chamber is a third diameter and the third diameter is bigger than the first diameter.

5. The hydraulic pressure valve apparatus of claim 4, wherein the head portion and the second chamber form an oil storing portion when the valve is opened.

6. The hydraulic pressure valve apparatus of claim 5, wherein an exterior diameter of the head portion is smaller than the third diameter.

7. The hydraulic pressure valve apparatus of claim 6, wherein a chamfer is formed where the body portion and the head portion are connected toward the second chamber direction.

8. The hydraulic pressure valve apparatus of claim 7, wherein the chamfer is formed as a curved surface.

9. The hydraulic pressure valve apparatus of claim 8, wherein a maximum diameter of the chamfer is bigger than the second diameter.

10. The hydraulic pressure valve apparatus of claim 9, wherein a tiny passage is formed to the first piston for controlling the valve closing speed.

11. The hydraulic pressure valve apparatus of claim 1, wherein:

the first chamber comprises:

a first body having an interior diameter as a first diameter; and a second body having an interior diameter as a second diameter and formed under the first body, wherein the second diameter is smaller than the first diameter.

12. The hydraulic pressure valve apparatus of claim 11, wherein an interior diameter of the second chamber is a third diameter and the third diameter is bigger than the first diameter.

13. The hydraulic pressure valve apparatus of claim 12, wherein the first piston has a cross section shaped as "T" and the first piston comprises a body portion and a head portion.

14. The hydraulic pressure valve apparatus of claim 13, wherein an exterior diameter of the head portion is smaller than the third diameter.

15. The hydraulic pressure valve apparatus of claim 14, wherein a chamfer is formed as a curved surface where the body portion and the head portion are connected toward the second chamber direction.

16. The hydraulic pressure valve apparatus of claim 15, wherein a maximum diameter of the chamfer is bigger than the second diameter.

17. The hydraulic pressure valve apparatus of claim 16, wherein a tiny passage is formed to the first piston for controlling the valve closing speed.

* * * * *